United States Patent [19]

Greenbank

[11] Patent Number: 4,785,761

[45] Date of Patent: Nov. 22, 1988

[54] MOBILE SEED CLEANING APPARATUS

[76] Inventor: Neville J. Greenbank, 127-135 Gillies St Sth, Ballarat, Victoria, Australia, 3350

[21] Appl. No.: 937,095

[22] Filed: Dec. 2, 1986

[51] Int. Cl.[4] ..... B05C 9/10; B05C 11/10; B07B 9/00; B07B 13/14

[52] U.S. Cl. ..... 118/682; 118/687; 209/10; 209/31; 209/44.1; 209/44.3; 209/234; 209/239; 209/421; 209/629; 209/634; 209/935; 241/101.7

[58] Field of Search ..... 209/687, 683, 935, 645, 209/389, 390, 10, 30–33, 44.1–44.3, 149, 234, 239, 420, 421, 629, 634; 99/516; 118/682, 687; 241/79.2, 79.3, 101.7

[56] References Cited

U.S. PATENT DOCUMENTS

| | | | |
|---|---|---|---|
| 453,185 | 6/1891 | Gschwender | 209/683 X |
| 796,745 | 8/1905 | Marot | 209/44.1 |
| 826,988 | 7/1906 | Bradbury | 209/234 X |
| 1,275,299 | 8/1918 | Pellerin | 209/390 X |
| 1,301,277 | 4/1919 | Kronenberg | 209/234 X |
| 1,522,724 | 1/1925 | Judson | 209/44.1 |
| 1,525,834 | 2/1925 | Traves | 209/234 X |
| 1,539,743 | 5/1925 | Keller | 209/234 X |
| 1,642,331 | 9/1927 | Bunse | 209/687 |
| 1,728,238 | 9/1929 | Gray | 209/687 |
| 1,809,701 | 6/1931 | Hoefling et al. | 209/44.1 |
| 2,047,508 | 7/1936 | Ingraham | 209/44.3 |
| 2,707,554 | 5/1955 | Dempsey | 209/44.2 |
| 2,785,798 | 3/1957 | Walker | 209/10 |
| 3,097,075 | 7/1963 | Vandenhoeck | 209/30 X |
| 3,111,483 | 11/1963 | Kibsgaard | 209/10 |
| 3,289,833 | 12/1966 | MacGillivray | 209/687 X |
| 3,827,554 | 8/1974 | Richard | 209/687 X |
| 4,403,669 | 9/1983 | Raz | 209/645 X |
| 4,508,029 | 4/1985 | Malone | 99/516 |
| 4,519,896 | 5/1985 | Vickery | 209/44.1 |

*Primary Examiner*—Robert B. Reeves
*Assistant Examiner*—Edward M. Wacyra
*Attorney, Agent, or Firm*—Brumbaugh, Graves, Donohue & Raymond

[57] ABSTRACT

A mobile seed cleaning and/or separating apparatus has a wheeled, self-propelled chassis mounting a plurality of cleaning and/or separating stations. The stations are interconnected by conveyors which transport the seed through the apparatus. The cleaning and/or separating stations include a coarse screen to remove material of a size larger than the seed to be separated, an aspirator to remove relatively light material, a pair of pocket cylinders to separate materials of different sizes and a screen cylinder to finally screen the seed. After cleaning, the seed passes through a weighing device which continuously batch-weights the seed and actuates a prickling machine to introduce a furyside, mold-inhibitor or other chemical.

14 Claims, 15 Drawing Sheets

57
58
56
64
63
62
39
61
42
41
54
126
127

58
4
63
64
4
90
92
93

60
55
63
59
60
55
58
63
78
66
79
67
68
74
73
77
76
128
129
126
127

56
57
10
59
101
96
95
93
102
87
104
103
86
106
107b
108
107
126
10
127

MOBILE SEED CLEANING APPARATUS

BACKGROUND OF THE INVENTION

This invention relates to mobile seed cleaning apparatus and relates particularly to apparatus for use in cleaning grain such as wheat, barely, oat, rice, sorghum, oilseed such as rape, sunflower linseed, and other seed such as lupins, peas, soybean and all other seeds which are grown for commercial purposes.

Harvested seed is generally impure in that it contains dirt, seed of undesired crop or other plants, improperly formed seeds, husks and the like. As such impurities affect the quality, and therefore the price, of the harvested crop it is usual for the seed to be cleaned and/or separated. Separation is required where two or more crops are grown and harvested together and it is necessary to separate one from the other for marketing or other use.

Before the present invention, it has been the usual practice for harvested crop to be transported to a storage area at which is located one form or another of a cleaning and/or separating equipment. Such equipment may comprise vibrating sieves, centrifugal separators, air separators, pocket cylinders and the like.

While such apparatus is relatively effective at a silo or other storage area, its use requires the harvested seed to be transported to the storage area where it can be treated. In many cases, however, such transportation of the seed is undesirable and unnecessary, particularly if the seed is not to be stored at the storage area. This may be the case where, for example, the seed is to be re-used by the farmer or is to be bagged and/or otherwise sold separately. The transportation of the seed to the storage area therefore becomes an unnecessary and undesirable handling involving additional cost for the farmer.

SUMMARY OF THE INVENTION

It is desirable to provide seed cleaning apparatus which avoids the disadvantage of having to transport the seed to the apparatus. For this purpose, the present invention envisages novel mobile seed cleaning apparatus.

It is also desirable to provide apparatus which is able to be used for cleaning and/or separating a wide variety of impurities and/or seed types from the crop.

It is also desirable that the seed cleaning apparatus be self-contained without need for external power sources or the like and that the apparatus is fully adjustable to take account of varying conditions, seed and impurity types.

According to one aspect of the invention there is provided seed cleaning apparatus comprising a mobile chassis mounting a plurality of cleaning or separating stations sequentially interconnected to cause seed to be cleaned to pass from a first station to a subsequent station and including:

(a) a coarse screen means onto which the seed is fed, the screen size permitting the seed to pass through the screen thereby separating material larger than the screen size, (b) an air separator means having air duct means and blower means to remove relatively light material, (c) pocket cylinder means having at least one pocket cylinder rotatable about an inclined axis at a predetermined speed to separate seed of different size, (d) screen cylinder means having interchangeable screen cylinders of predetermined mesh size rotatable about a longitudinal axis with internal scraper means to urge seed through the screen cylinder mesh, and (e) conveyor means continuously moving seed from one station to the next.

The coarse screen means is preferably a screen cylinder having relatively large mesh which will keep out of the cylinder large objects whilst allowing the seed to flow freely into the cylinder. The cylinder is rotatable and large objects are carried on the rotating surface and fall from the cylinder, at one side thereof, for discharge to waste. The seed entering the cylinder passes therethrough and gravitates to the next station.

A feature of the present invention is the close coupling of the various cleaning or separating stages which requires minimum and relatively simple conveyors to move the seed therebetween. The conveyors may take the form of augers, bucket conveyors or paddle conveyors. The bucket and paddle conveyors are used for lifting seed while the augers are used for horizontal and angular conveyancing.

In one preferred form, the apparatus includes an automatic weighing device which accurately weighs cleaned seed prior to discharge to a bagging or other outlet. Chemical treatment, such as fungus or mold retardants and the like can be automatically added to the cleaned seed prior to discharge through the outlet.

Many other novel features of the invention will become apparent from the following description of a preferred embodiment of the invention described with reference to the accompanying drawings.

DESCRIPTION OF PREFERRED EMBODIMENT

The apparatus illustrated comprises a mobile seed cleaning apparatus which comprises a plurality of cleaning and/or separating stations mounted together on a mobile chassis and having conveyor means interconnecting the separate stations for conveying seed therebetween.

Figure 1:
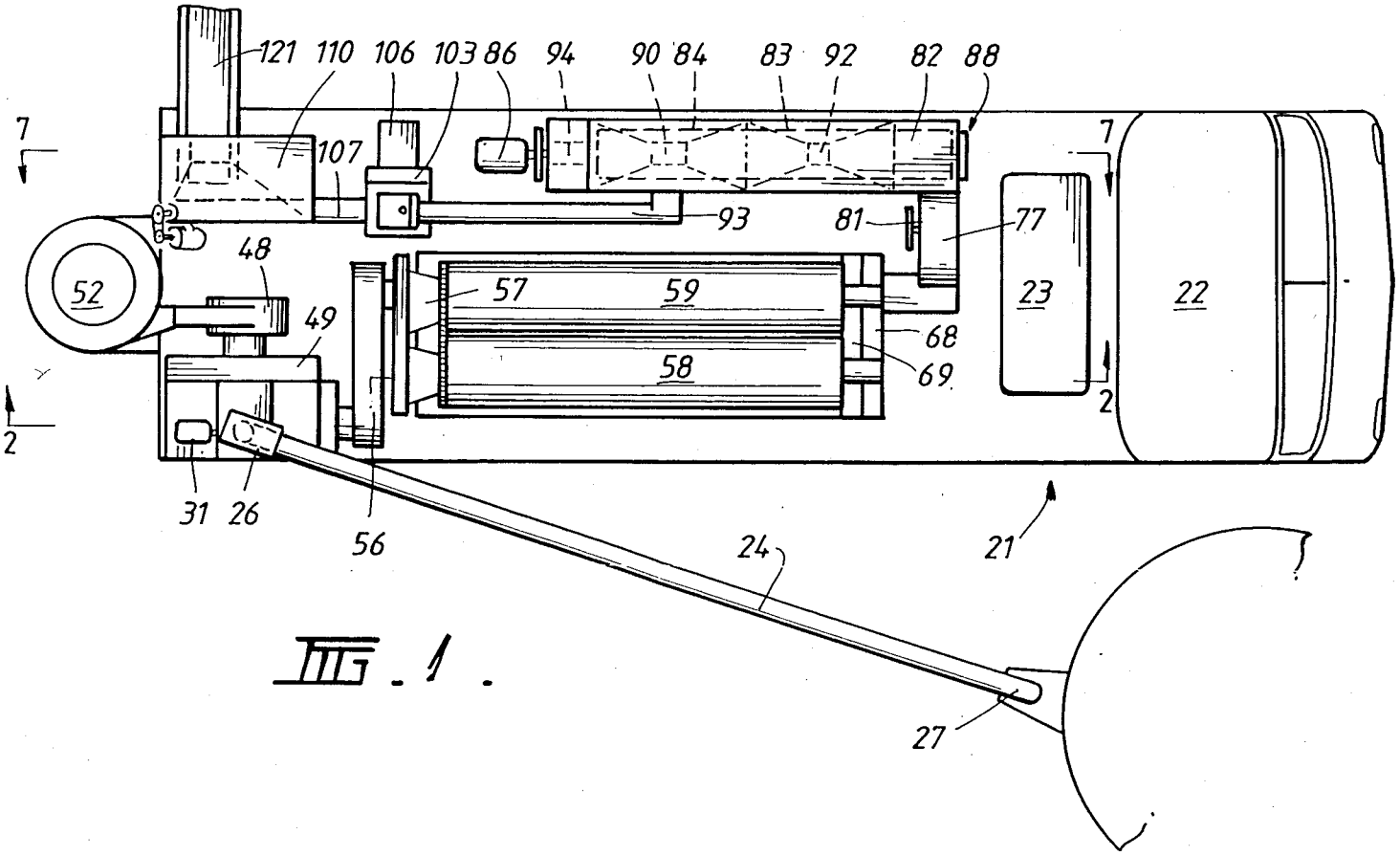
FIG. 1 is a plan view of one form of mobile seed cleaning apparatus constructed in accordance with the invention.

As shown in FIG. 1, the mobile chassis consists of a self-propelled vehicle 21 having a front cab 22 immediately behind which is located a motor-generator set 23 which produces electrical power for operating the various electric motors used in the apparatus. If desired, a fixed or removable roof may extend rearwardly from the cab 22 to cover the various parts of the apparatus to be hereinafter described. FIG. 1 shows the apparatus with the roof removed.

The self-propelled vehicle 21 can be driven to the location of seed to be cleaned which may be at the farmers property, at a storage area, silo or other location. The ability to be able to move the cleaning apparatus to the seed rather than vice versa avoids a large amount of double handling and seed transport costs.

In the apparatus illustrated in the drawings, a swivel feed auger 24 is pivotally mounted on a secondary thresher 26 located adjacent the rear of the vehicle 21. The free end 27 of the swivel feed auger 24 constitutes the inlet for seed to be cleaned. The free end 27 may be positioned in a storage silo or dump and rotation of the auger conveyor 28 within the auger tube 29 feeds seed to the thresher 26.

The secondary thresher 26 can be operated, if desired, to thresh seed prior to cleaning. Such threshing will not be desirable or necessary for some seeds and, accordingly, the thresher can be by-passed if not used. In use, the thresher is driven by an electric motor 31 which rotates a shaft containing a plurality of spaced pegs 32 which pass between fixed upstanding fingers 33. Seed falling from the swivel feed auger 24 lands on angled platform 34 and gravitates through the fingers 33 to be contacted by the rotating arms 32 to remove husks, stalks and the like.

If the thresher 26 is not to be used, the platform 34 and fingers 33 are moved to a position whereby the seed may gravitate directly from the swivel feed auger 24 to the thresher outlet 36.

The outlet 36 is defined by an angled floor member 37 movable by handle 38 to vary the outlet size.

From the outlet 36, the seed passes to a coarse screen cylinder 39 the surface of which is formed of relatively large size mesh. The cylinder 39 is rotated by electric motor 41 driving through appropriate V-belts 42.

A flexible or resilient flap 43 engages the cylinder 39 along one side causing seed and other entrained matter to contact the mesh surface of the cylinder 39. The seed, being of a size substantially smaller than the mesh size, passes through the mesh and into the cylinder interior from where it gravitates through the cylinder surface at a lower level to a tapering outlet 44. Any material which is too large to pass through the mesh openings is carried by the rotating cylinder and falls from the surface thereof to a waste outlet 46.

The tapering seed outlet 44 directs the seed towards the throat 47 of an aspirator which comprises a blower 48, an air passageway 49 and the throat 47. Air drawn by the blower 48 moves past the outlet 44 through the throat 47 constituting a venturi and into the passageway 49. The air current is such as to pick up seed from the outlet 44 and carry the seed into the passageway 49. Any impurities entrained by the seed also get carried into the passageway 49. The passageway 49 has a greater cross-sectional area than that of the throat 47 which causes the air velocity to diminish and allows seed and other material of similar mass to fall back through the throat 47 into the auger channel 51. Lightweight material, such as husks, stalks, leaves and the like are carried upwardly by the air flow in the passageway 49 and are discharged by the blower into a cyclone collector 52 mounted on the back of the vehicle 21. The cyclone collector 52 collects dust and other light material which is bagged for removal at the bagging station 53 located on the bottom of the cyclone collector 52.

The blower 48 is driven by a variable speed electric motor (not shown) and is adjustable to control the air flow through the throat 47 and along the air passageway 49 commensurate with the particular seed being cleaned. Thus, for relatively light seed, the blower speed is reduced compared to a relatively heavy, larger seed. A viewing window 50 is mounted in the side wall of the passageway to enable an operator to vary the blower speed to obtain the correct air flow while monitoring the effect on the seed.

The auger conveyor 54 in the auger channel 51 conveys the seed to a paddle conveyor 56 which elevates the seed to a distribution manifold 57 which distributes the seed evenly between a pair of indented or pocket cylinders 58 and 59. The pocket cylinders 58, 59 each comprises a cylinder the cylindrical surface of which is formed with a large number of internal indentations or pockets in the cylindrical surface. The axes of the pocket cylinders 58, 59 are tiltable by means of hydraulic cylinder 61 thus causing seed in each cylinder to gradually move from the inlet end towards the outlet end. The cylinders 58, 59 are rotated by an electric motor 62, the speed of rotation being variable in accordance with the type of seed being treated.

Within each pocket cylinder 58, 59 is disposed a longitudinally extending collection trough 63 housing a conveyor auger 64. Each collection trough 63 is movable about its axis by means of gears 66 interconnected by a chain 67. (FIG. 6) The desired location of the collection trough will be dependent on the seed being cleaned and the speed of the pocket cylinders 58 and 59. In use, seed is picked up in the pockets of the pocket cylinders 58, 59 and is carried thereby on rotation of the cylinders until the gravitational force equals the centrifugal force holding the seed in the pocket. At this point, the seed will fall from the pocket. These cylinders are used to separate long from short grain or seed, and seed which is shorter and therefore sits further into the pocket will be carried further than longer seed due to the greater centrifugal force thereon. The pocket cylinders can, therefore, clearly separate one seed from another with a clear division occurring during rotation of the cylinder. The collection trough 63 is adjusted during initial operation of the apparatus to ensure that the appropriate separation takes place.

At the outlet end, the pocket cylinders 58, 59 each have a movable baffle 45 carried by an arm 60. The baffle position is adjustable by the fastening screw 55 to be located across the end of the respective cylinder and restrict movement of grain or seed from the outlet end. The grain or seed is, therefore, caused to be carried up by the pockets a greater number of times than would otherwise occur thus improving separation. The effect of the baffles 45 is to effectively lengthen the cylinders 58, 59. For some grains and seeds, the baffles 45 are not necessary and are moved from a baffling location.

Figure 2A:
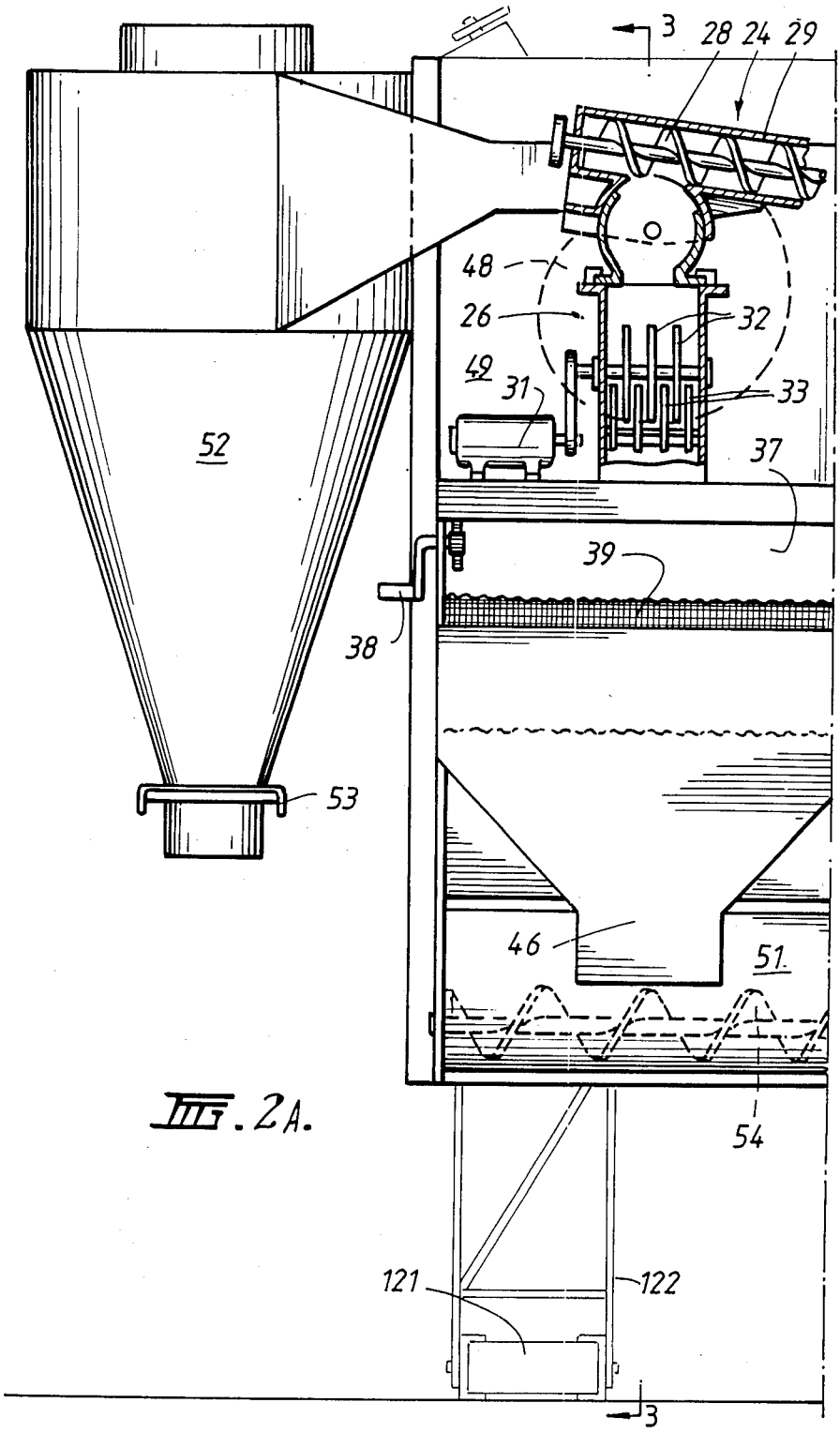
FIGS. 2A, 2B, 2C and 2D together form a cross-sectional view along the lines 2—2 of FIG. 1.
Figure 2B:
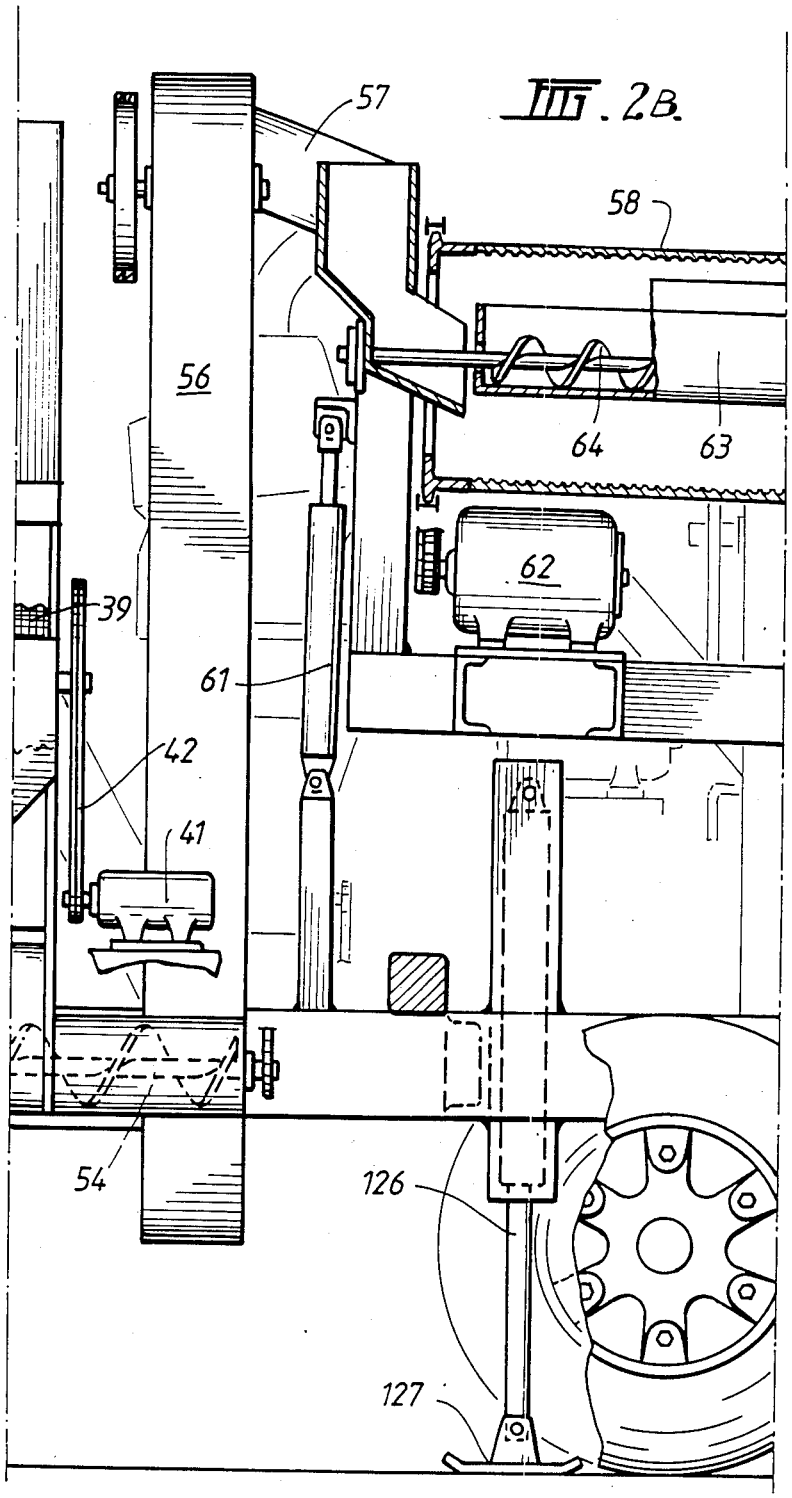
Figure 2C:
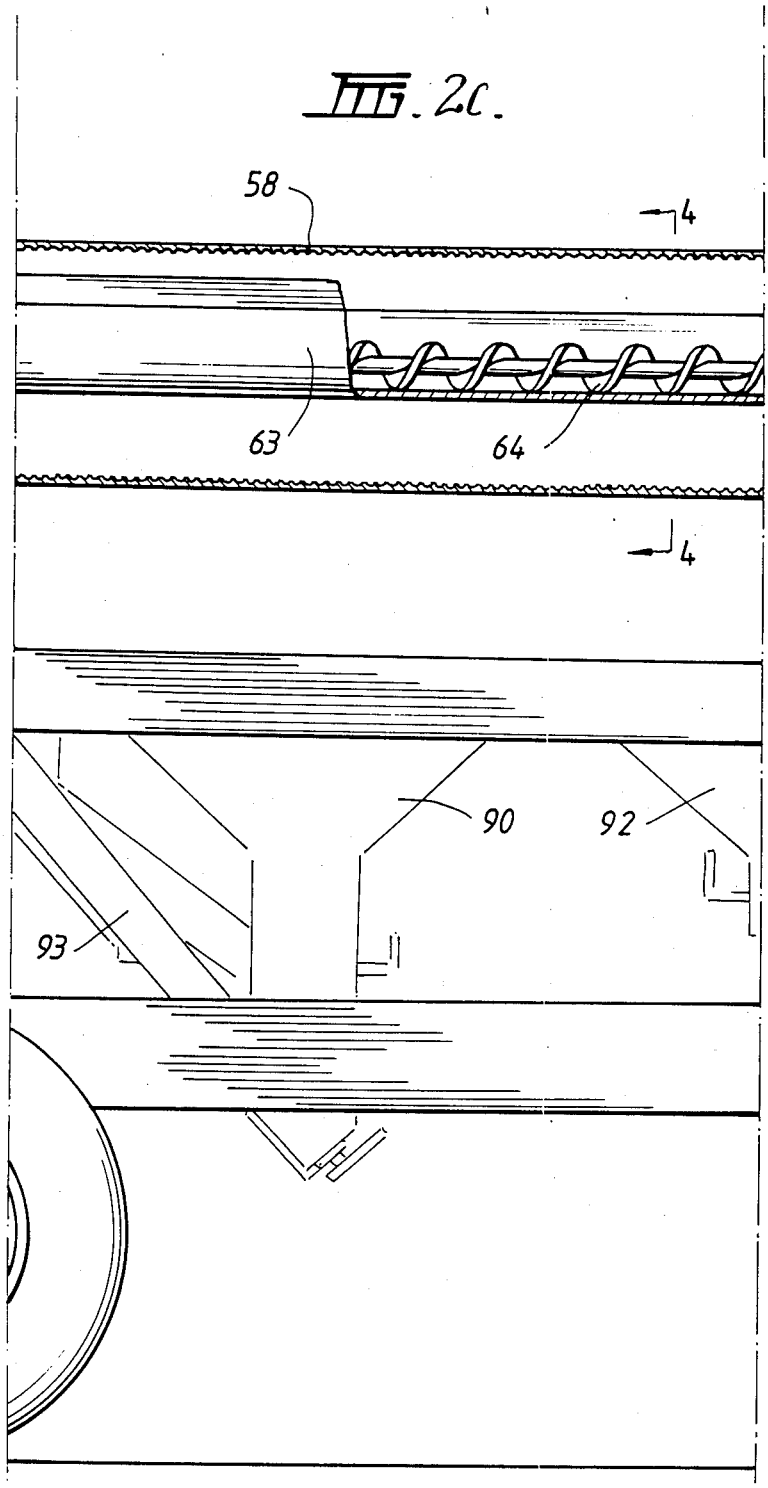
Figure 2D:
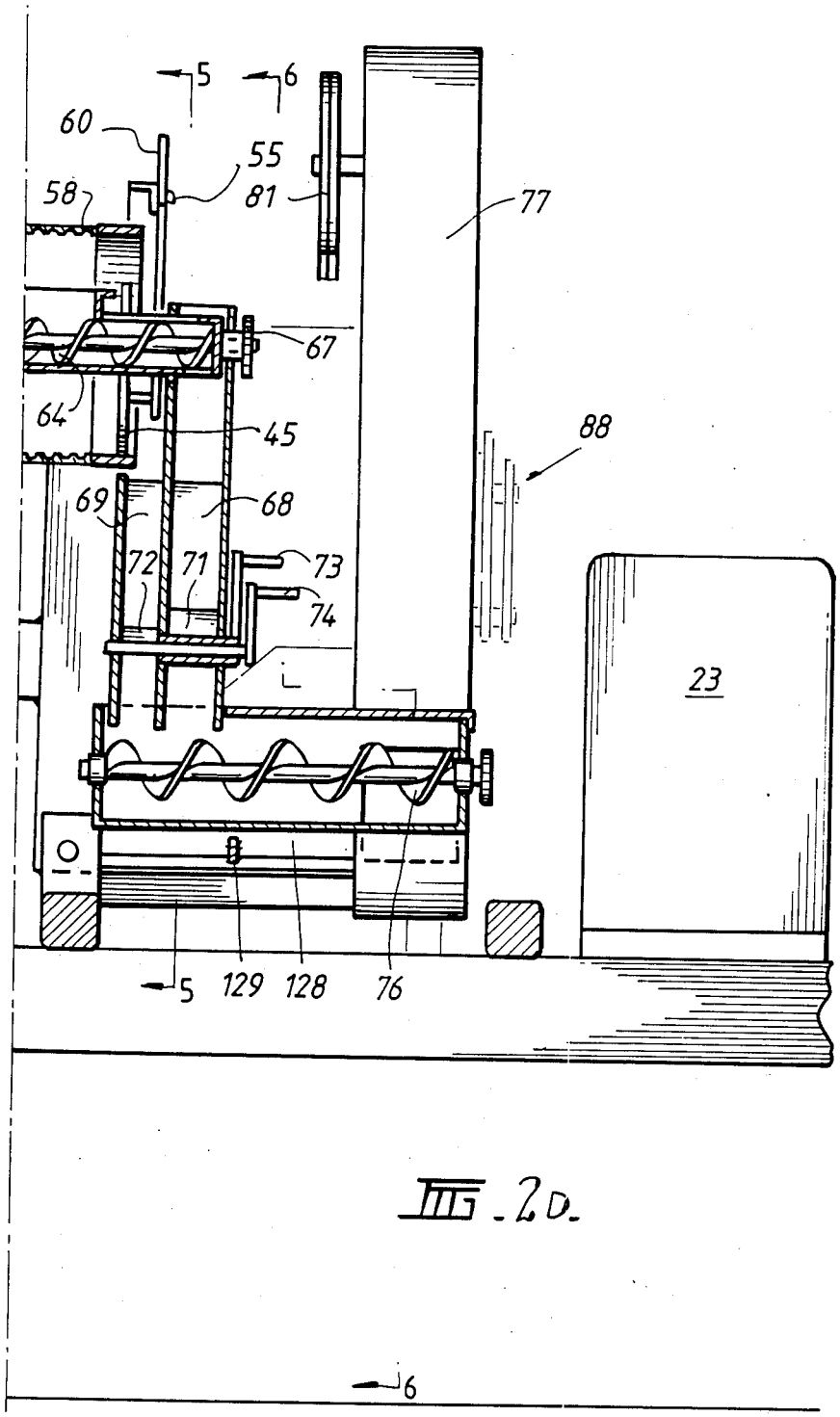
Figure 5:
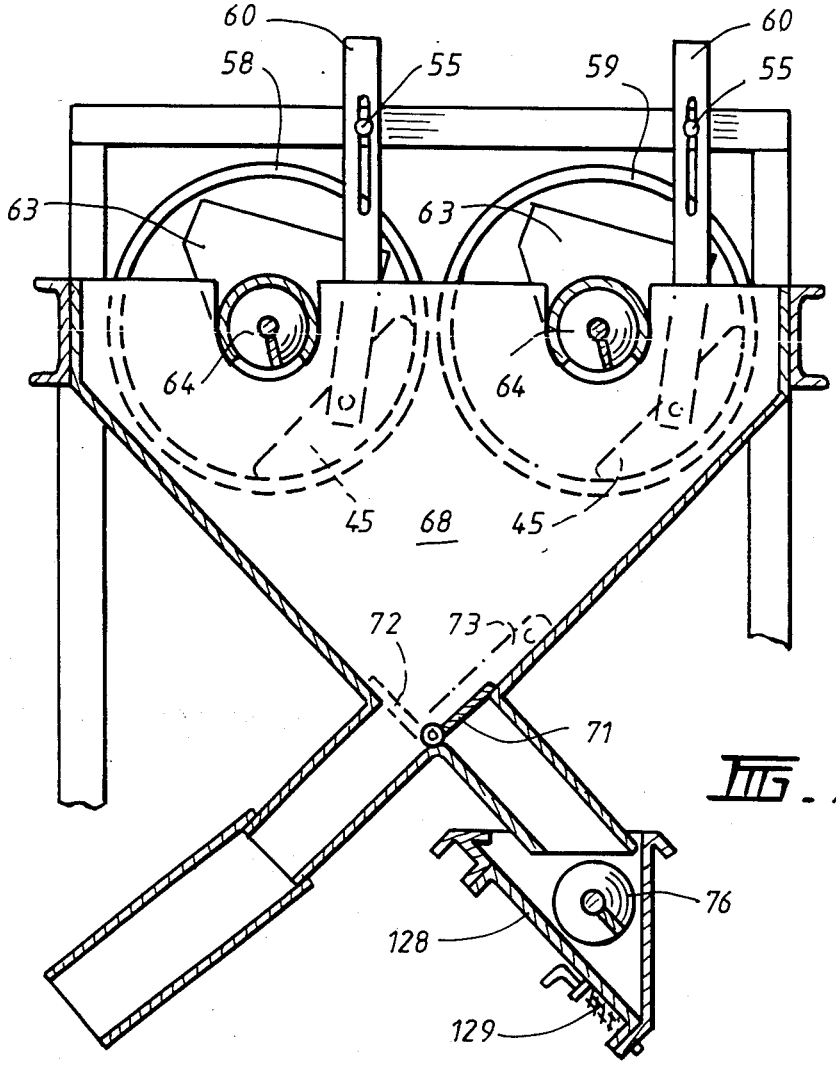
FIG. 5 is a cross-sectional view taken along the lines 5—5 of FIG. 2D.
Figure 6:
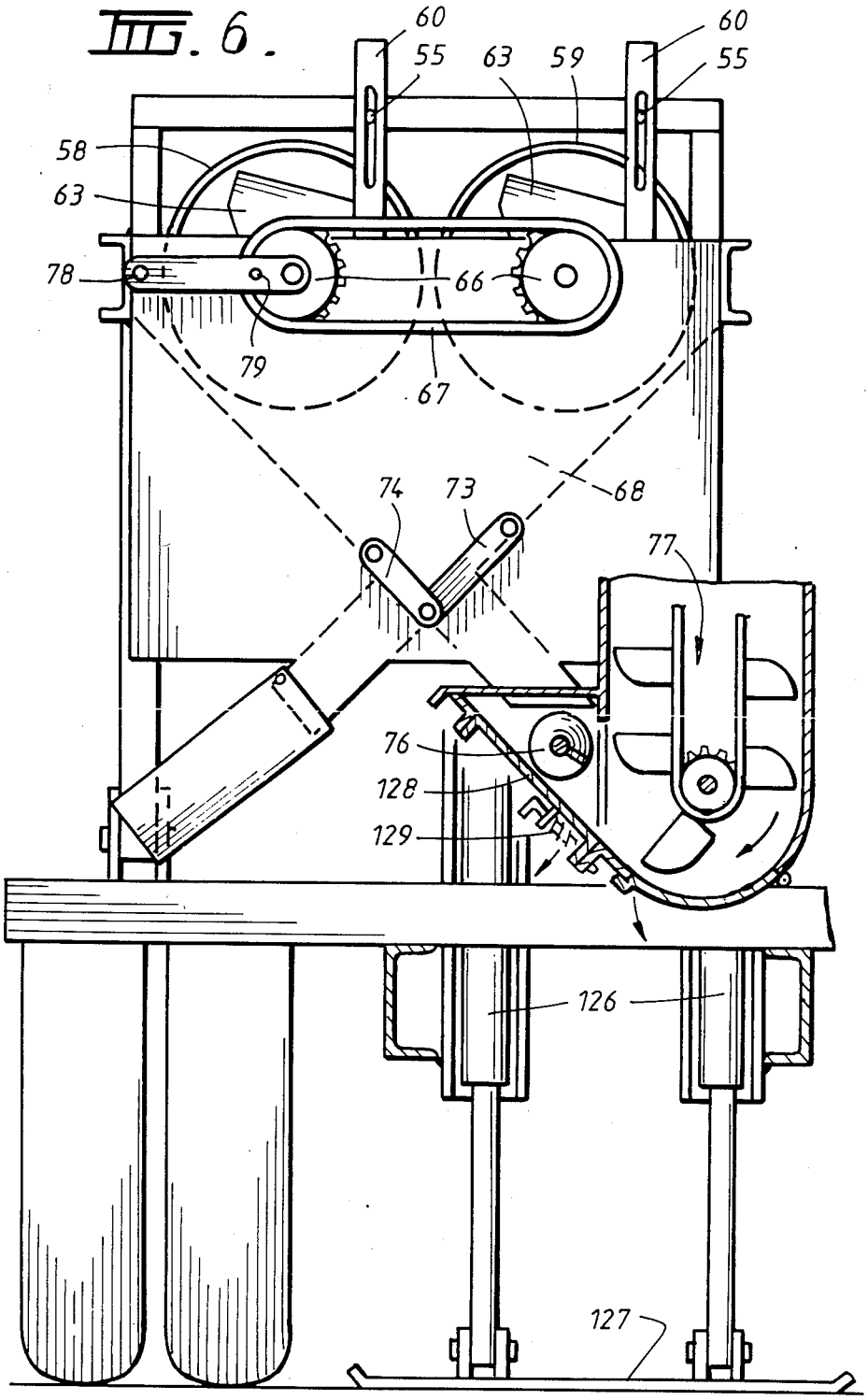
FIG. 6 is a cross-sectional view taken along the lines 6—6 of FIG. 2D.

As shown in FIGS. 2D, 5 and 6, material discharged from the collection troughs 63 passes into a first outlet chamber 68 while material discharged from the interior of the cylinders 58, 59 passes to a second outlet chamber 69. Each of the chambers 68 and 69 is provided with a changeover flap valve 71, 72, respectively operated by handles 73 and 74. Thus, either the material from the collection troughs 63 (short grains) or the material from the interior of the cylinders 58, 59 (longer grains) can be discharged to waste with the other material being directed by a conveyor auger 76 to a further, bucket, elevator 77.

As indicated above, the relative position of the collection troughs 63 is changed by means of the gears 66 and chain 67. A handle 78 is fixed to one of the gears 66 and has a releasable pin 79 to engage the gear to cause movement thereof. Disconnection of the pin 79 prevents inadvertent movement of the gear 66.

Figure 7A:
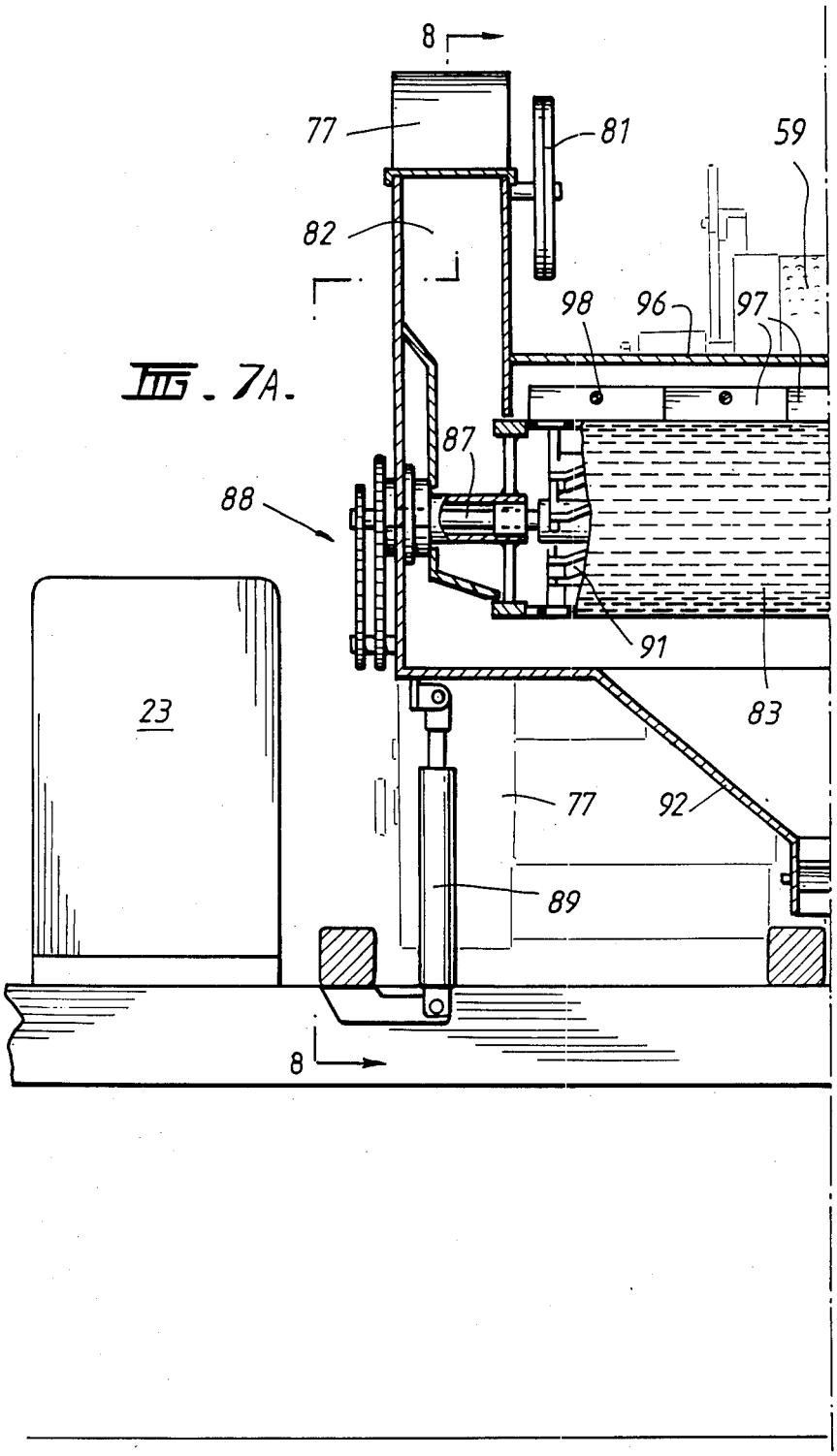
FIGS. 7A, 7B, 7D and 7C, taken together, constitute a cross-sectional side-elevational view taken along the lines 7—7 of FIG. 1.
Figure 7B:
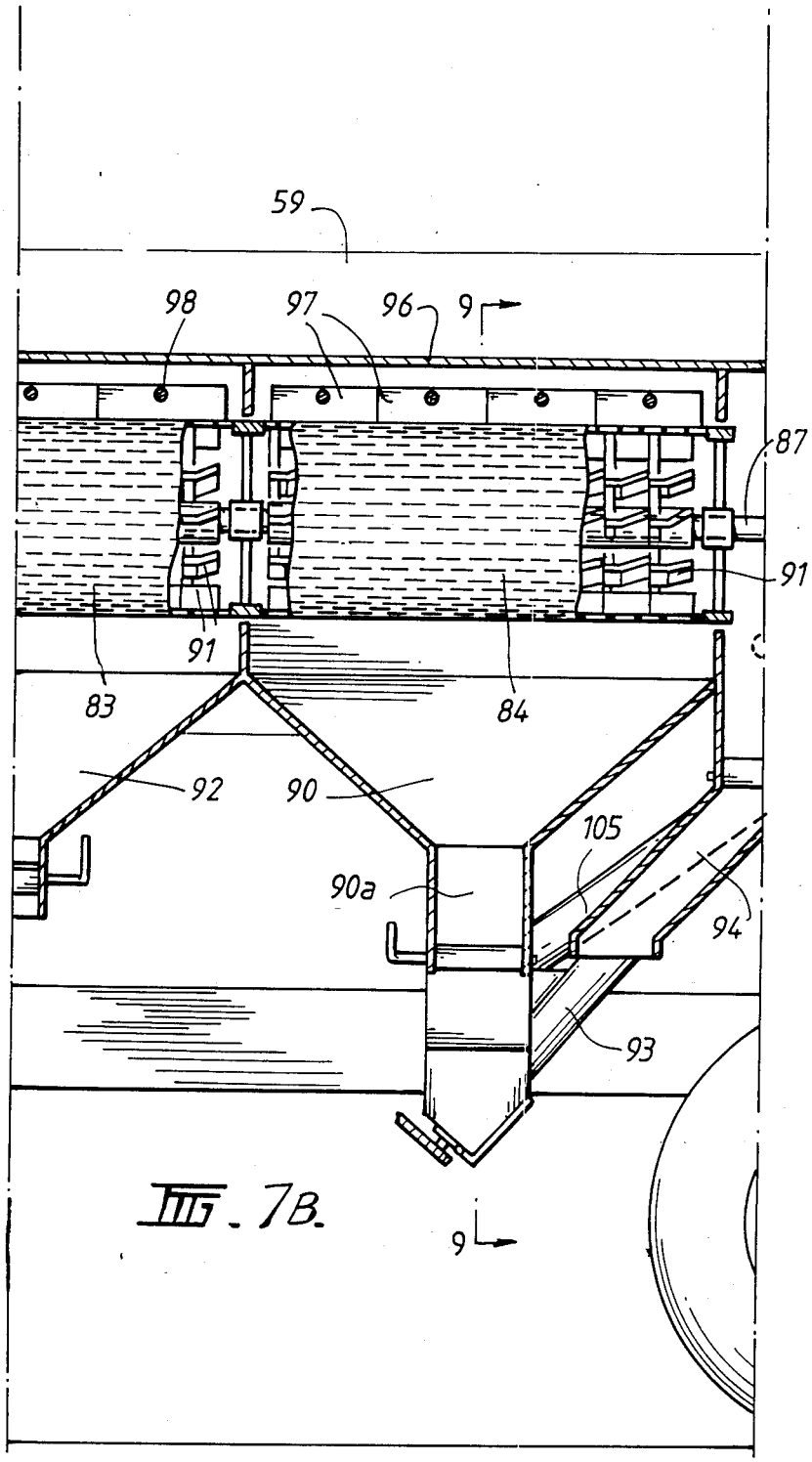
Figure 7C:
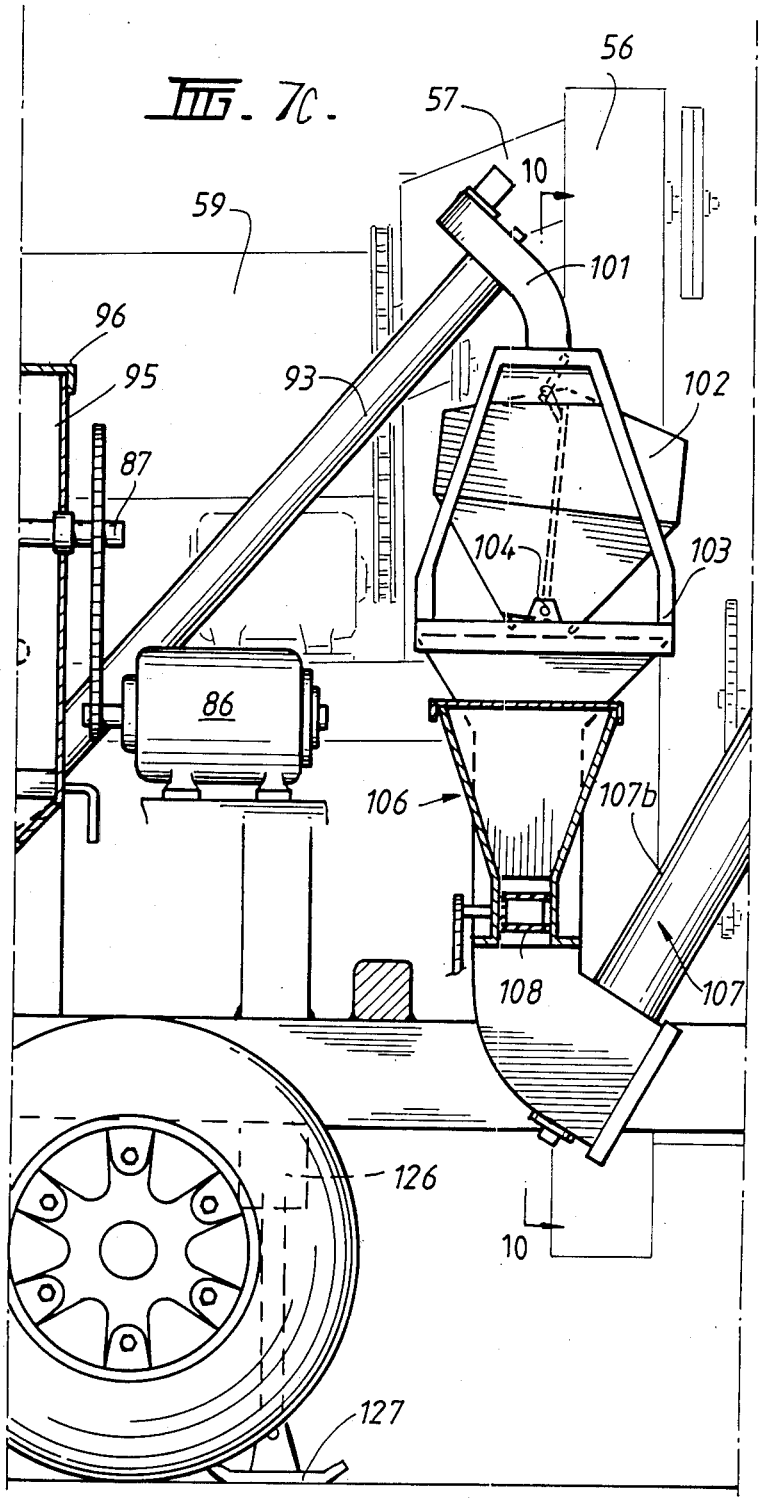

The bucket elevator 77, which is driven by an electric motor (not shown) through the pulley 81, elevates the separated seed to a hopper 82 feeding a pair of axially aligned mesh cylinders 83, 84. A variable speed electric motor 86 (FIG. 7C) drives an internal shaft 87 which, in turn, drives the cylinders 83, 84 through speed reduction gears indicated generally at 88 (FIG. 7A). The axis of the mesh cylinders 83, 84 is adjustable by hydraulic cylinder 89 so that the cylinders are substantially horizontal or slope slightly downwardly towards the outlet end.

The mesh cylinders separate seed by width. With various mesh sizes a wide range of separation can take place, for example, thin oats out of normal plump oats.

Fixed to the shaft 87 is a series of paddles 91 longitudinally and circumferentially spaced. The paddles are rotated at the speed of the shaft 87 which is approximately half that of the rotational speed of the drum, but in the same direction thereas. The paddles 91 are each formed with a part extending substantially axially and a second part extending at an angle to both the axis and a perpendicular plane. The paddles engage the internal surface of each mesh cylinder 83, 84 and act to move seed entering the cylinder 83 from the hopper 82 through the respective cylinders 83, 84 and, at the same time, urging material through the mesh apertures in the cylinder surfaces.

The first mesh cylinder 83 has relatively small mesh openings which are of a size to prevent the desired seed passing therethrough but which will allow through thinner material which has not been previously separated. The second mesh cylinder 84 has a mesh opening size such that the desired seed will pass therethrough. In this way, the cylinders act to separate the desired seed from both thinner and larger material.

Naturally, the mesh material forming the mesh cylinders 83 and 84 is readily changeable dependent on the seed being separated or otherwise treated.

A bagging chute 92 is located beneath the first mesh cylinder 83, the chute 92 having a closeable outlet to enable bagging or other disposal of the separated rubbish. The seed outlet 90 beneath the second mesh cylinder 84 is divided into a bagging outlet **90*a*, with an appropriate flap door and closeable butterfly, and an angled, transversely directed discharge part 100 to discharge seed to an angled auger conveyor 93 located behind the outlet 90. The material which is discharged from the end of the mesh cylinder 84 either passes to a further bagging chute 94, similar to the chute 92, or, depending on seed being separated, may be caused to flow down outlet tube 105 to the auger conveyor 93**.

The mesh cylinders 83, 84 are disposed within a housing 95 having a removable lid 96 which provides access to the cylinders for purposes of replacement of the mesh, maintenance and the like. A series of scraper blades 97 are disposed along the top of the cylinders 83, 84 in overlapping relationship and are supported by arms 98 to engage the outer surface of each cylinder and assists in removal of material therefrom.

The auger conveyor 93 conveys the cleaned seed to a weighing mechanism which consists of a Kongskilde dump weigher. This weighing device is known in the art and will not be described in detail. It will be noted, however, that seed passes from the auger conveyor 93 through the passageway 101 into one side of the weighing hopper 102 which is pivotally mounted on a supporting frame 103. As soon as a predetermined amount of seed has entered the hopper 102, the hopper rocks about its pivotal mounting 104 so that the passageway 101 then discharges seed into the other side of the hopper 102. The filled hopper side discharges the seed therein through the bottom of the weighing device passed a pickling machine 106 to a further angled auger conveyor 107.

When the second side of the hopper 102 has been filled with the selected, predetermined amount of seed, the hopper again pivots about the pivotal mounting 104 to its original position and the first side then receives seed from the passageway 102 while the second hopper side discharges. By presetting the quantity of seed necessary to cause the pivotal rocking movement of the hopper 102 and by counting the number of such movements, the total amount of seed passing therethrough is easily and simply determined. A trip counter (not shown) mounted on the frame 103 is actuated on each movement of the hopper 102 and, if the hopper is set for movement for each ten kilogram of seed, the total weight of seed passing therethrough is easily determined.

A microswitch is also mounted on the frame 103 and is actuated on each movement of the hopper 102. The microswitch actuates a timer and an electric drive motor (not shown) driving a conveyor belt 108 located beneath the pickling machine 106. The pickling machine 106 has a chemical hopper 109 in sealing relationship with the conveyor belt 108, the chemical hopper 109 containing a liquid or powder chemical used for treating the cleaned seed, such as a pesticide, fungicide mold inhibitor or other seed dressing. On actuation of the drive motor, the conveyor belt 108 moves a predetermined amount before the timing device deactivates the drive motor. The predetermined amount governs the amount of chemical which is conveyed by the conveyor belt 108 and deposited onto the seed which has passed to the base of the auger conveyor 107. A predetermined amount of chemical is therefore deposited for each measured quantity of cleaned seed.

The auger conveyor 107 is a mixer and conveyor auger which comprises an auger **107*a* rotating within a tube 107*b* of greater diameter than that of the auger. This arrangement allows seed to be picked up by the rotating auger 107*a* but permits some seed to gravitate towards the lower end of the tube 107*b* during rotation of the auger 107*a*. The mixing auger 107*a* thoroughly mixes chemical with the seed during the conveyance to the upper end of the conveyor 107**.

At the upper end, seed is discharged into a storage hopper 110 from where it may be bagged or otherwise discharged. charged.

For bagging purposes, the apparatus includes a floating collar 111 surrounding the outlet of the hopper 110 and being carried on a pair of arms 112 pivoted to a frame member 113. A pneumatic or hydraulic cylinder 114 supports the outer ends of the arms 112 and permits only relatively gradual vertical movement thereof. Scales 116 extend between a wall of the storage hopper 110 and the collar 111 to enable an operator to fill bags of different sizes with a desired amount of seed.

The bag 117 is held on the collar 111 by a clamping ring 118, or the like. With a bag in position, an outlet door 119 on the storage hopper 110 is opened to allow seed to enter the bag 117.

Figure 3:
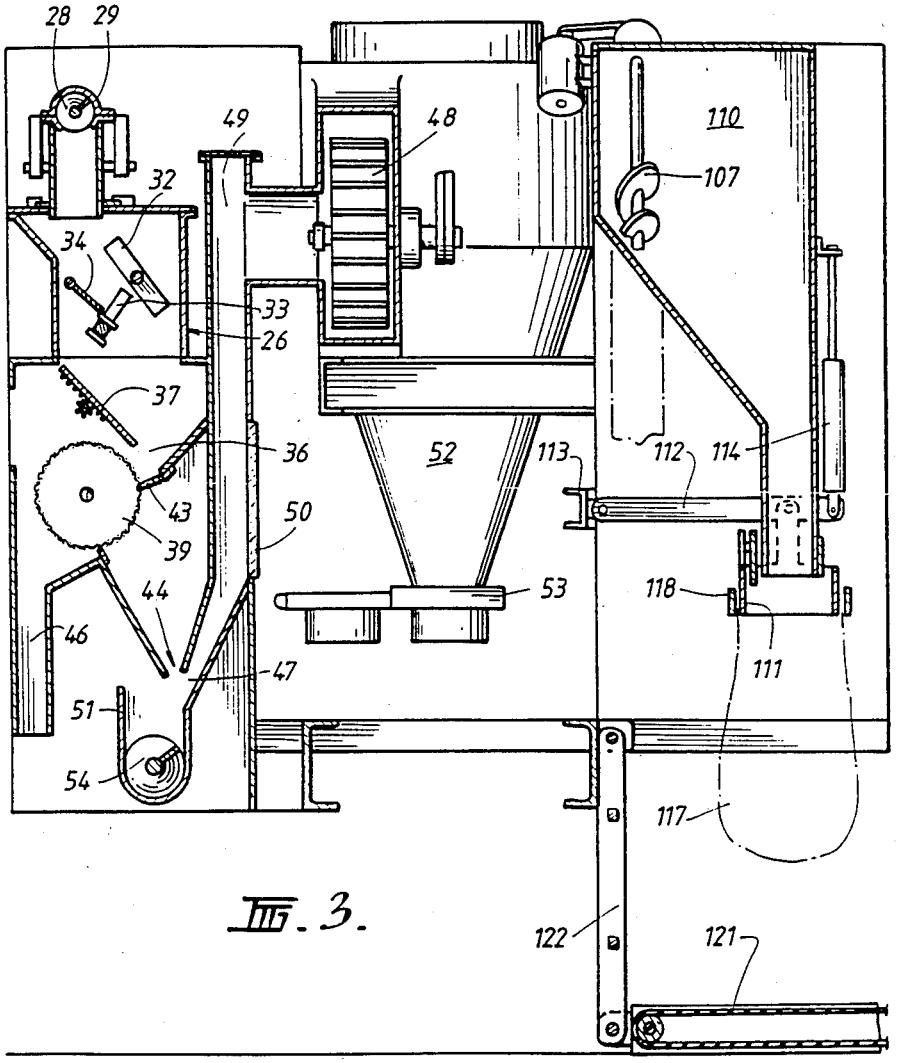
FIG. 3 is a view taken along the lines 3—3 of FIG. 2A.
Figure 4:
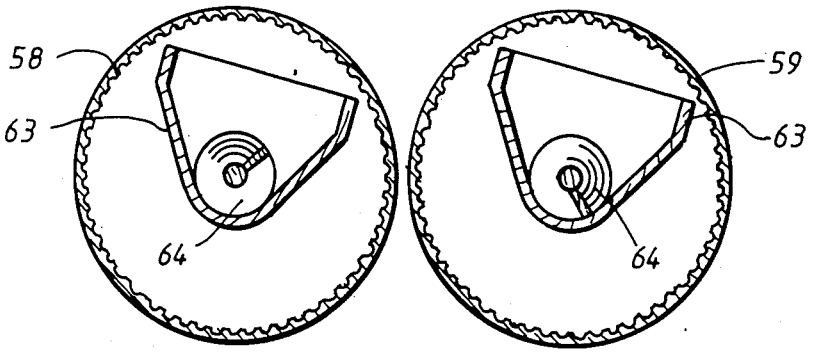
FIG. 4 is a cross-sectional view taken along the lines 4—4 of FIG. 2C.
Figure 7D:
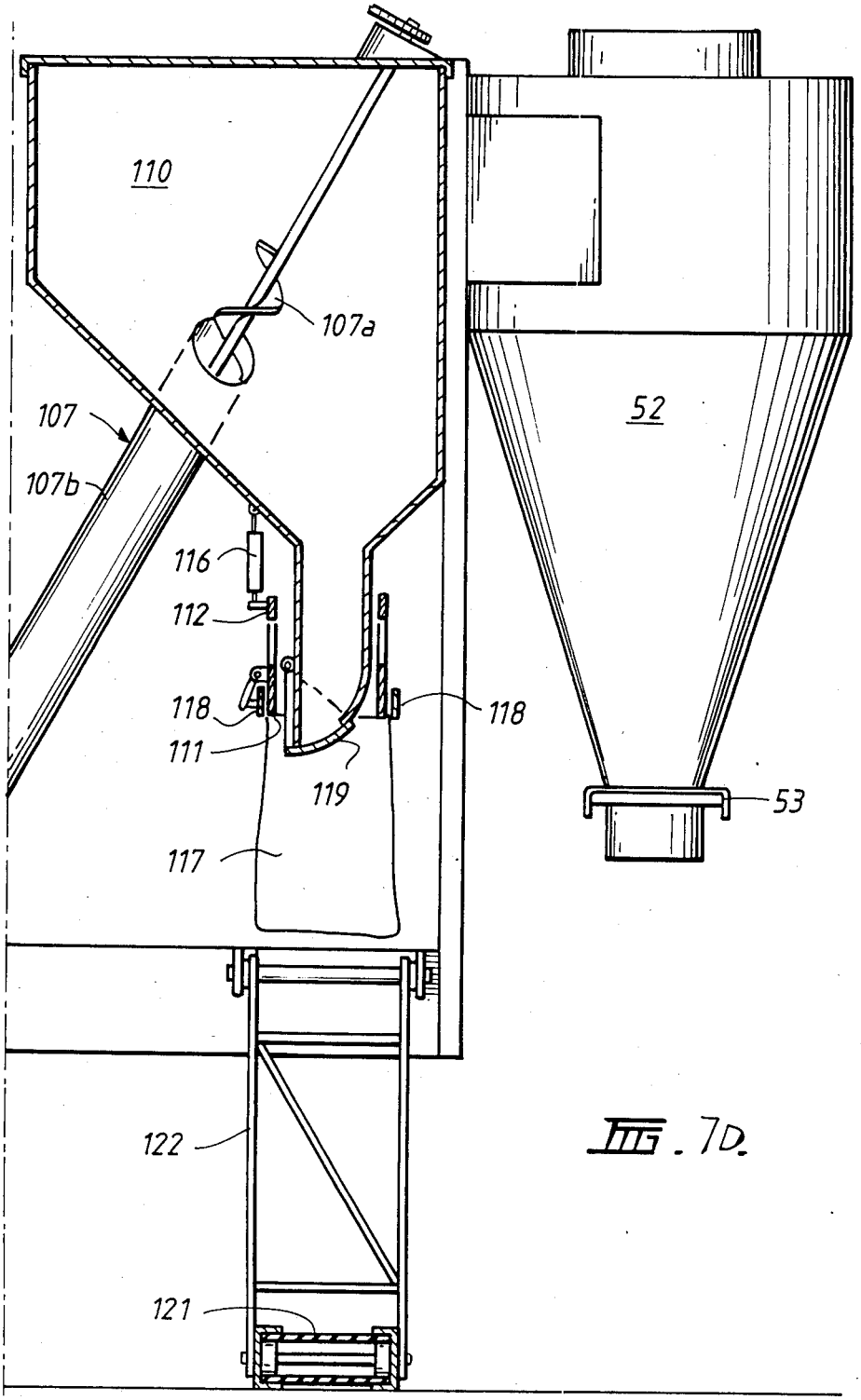
Figure 8:
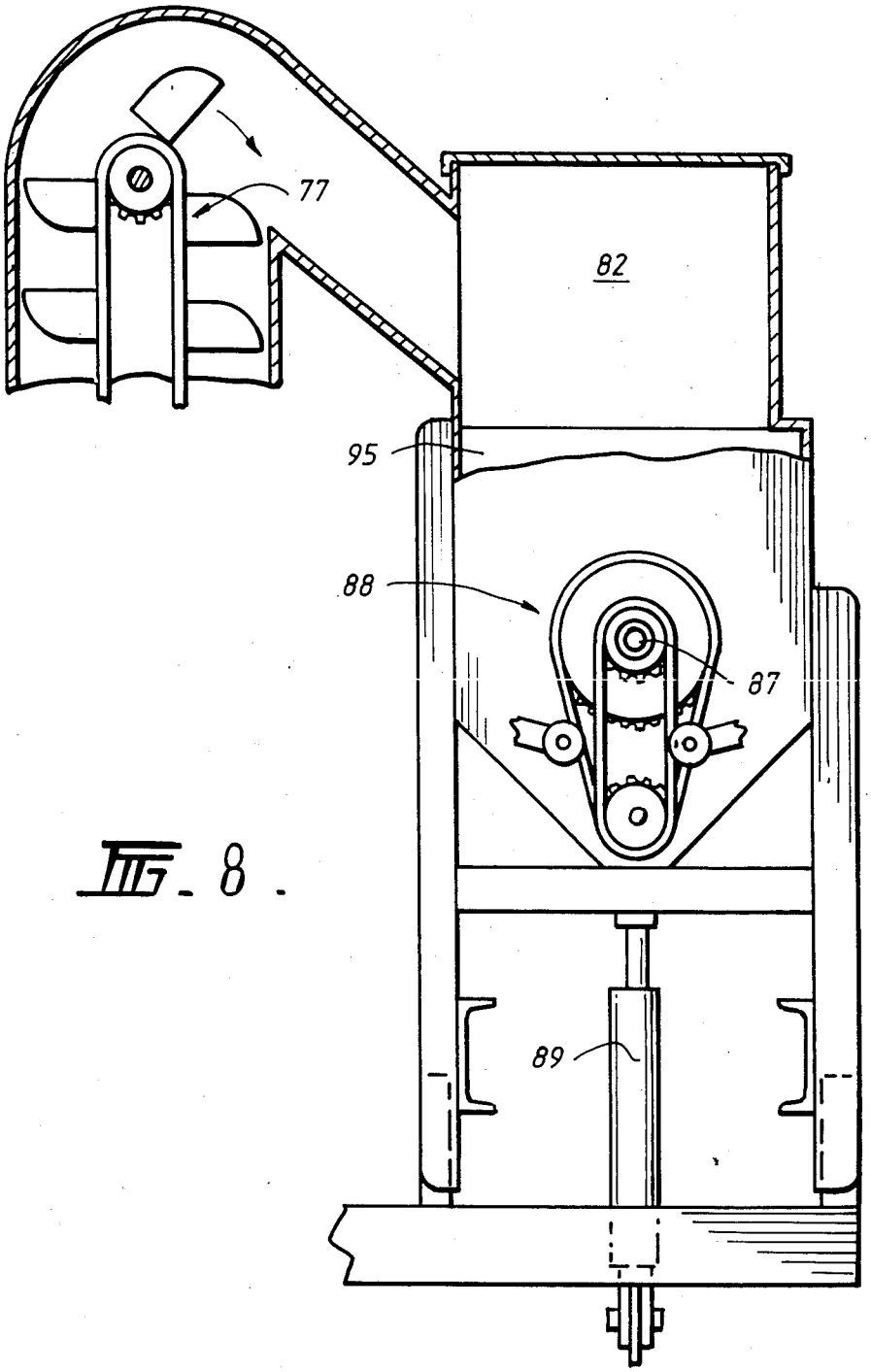
FIG. 8 is a part cross-sectional view taken along the lines 8—8 of FIG. 7A.
Figure 9:
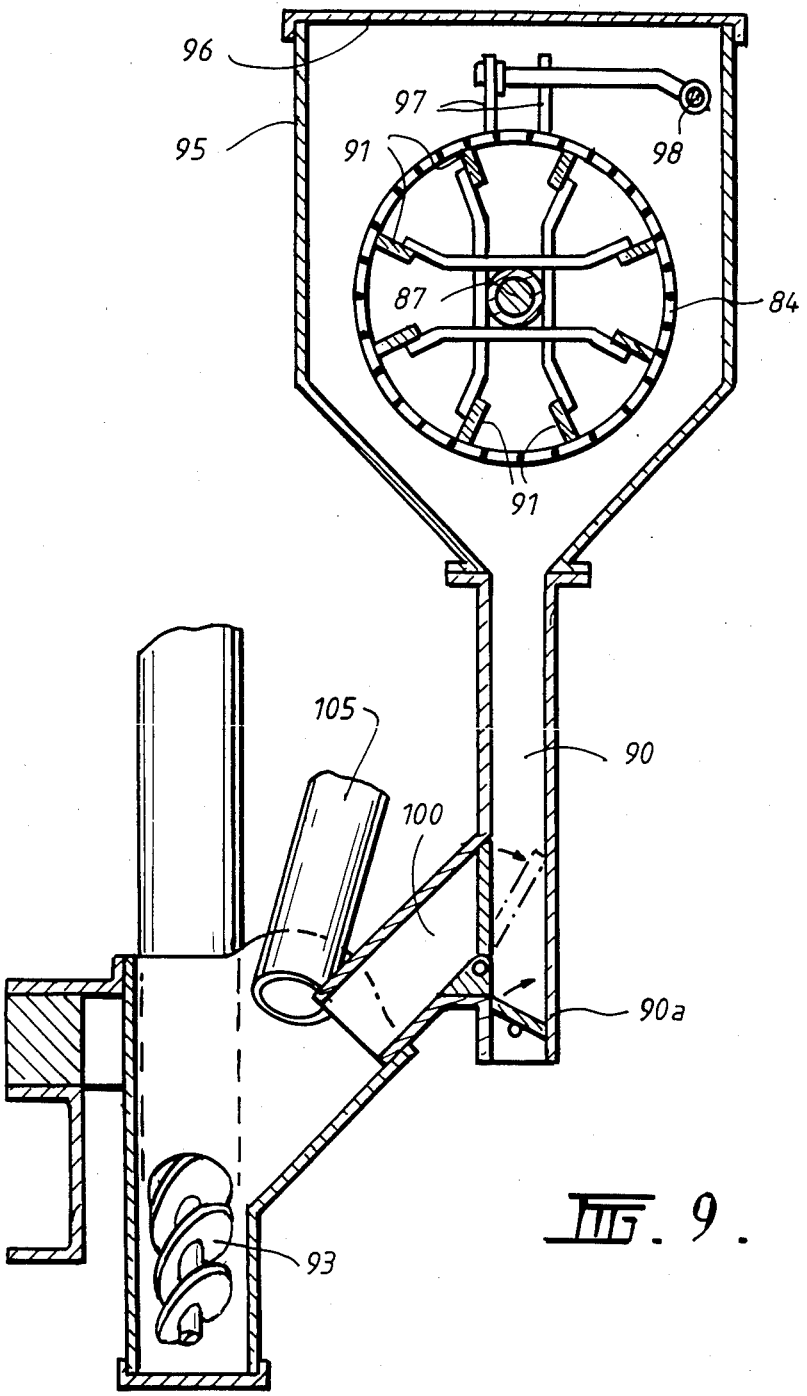
FIG. 9 is a view taken along the lines 9—9 of FIG. 7B.
Figure 10:
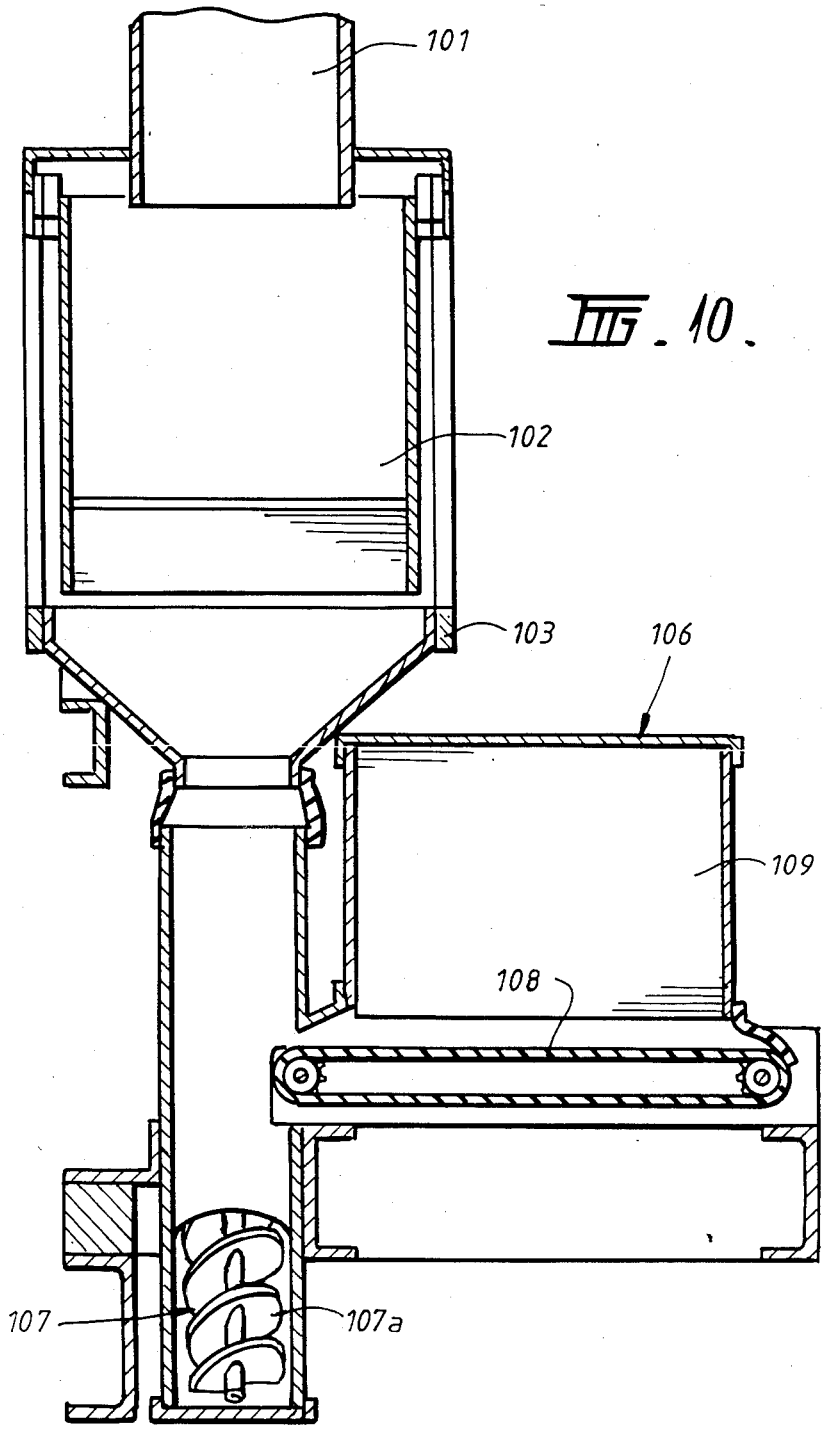
FIG. 10 is a view taken along the lines 10—10 of FIG. 7C.

A horizontal bag conveyor 121 is pivotally mounted to a folding frame section 122 pivoted to a frame member of the vehicle 21. In use, the folding frame section 122 and the conveyor 121 are moved to the position shown in FIGS. 3 and 7D immediately beneath the outlet of the storage hopper 110 so as to convey away filled bags of cleaned seed. The conveyor 121 is electrically driven by a motor (not shown) and as the bags are moved away from the bagging station they can be sewn using an electric sewing machine balanced on an overhead frame (not shown).

For transportation, the conveyor 121 and the folding frame section 122 are pivoted about their respective pivotal connections to take up a vertical position on the side of the hopper 110.

In use, the vehicle 21 is moved to the site of the seed to be cleaned and the vehicle is positioned so as to be substantially level. Built in longitudinal and transverse bubble levels (not shown) are incorporated on the vehicle for this purpose. Additionally, the vehicle is provided with a pair of hydraulic jacks 126 mounted on a footplate 127 and independently operable to enable the vehicle 21 to be levelled when parked on uneven ground.

On completion of a seed cleaning operation, it is necessary that the equipment be thoroughly cleaned to prevent contamination of the next crop handled. For this purpose, the various auger conveyors, paddle and bucket conveyors and passageways are provided with access and cleaning doors. Thus, the bucket elevator 77 shown in FIG. 6 is provided with a hinged access door 128 normally held closed by spring loaded catch 129. All the conveyors and passageways are provided with similar access and cleaning doors.

During use, various conveyors and hoppers are subject to dust extraction using the blower 48 with appropriate air ducts so as to reduce to a minimum the amount of grain dust.

All equipment on the vehicle is electrically driven receiving power from the motor-generator set 23. Appropriate electrical protection and control apparatus is provided to facilitate accurate control of each operation and protection in the case of any malfunction.

While the invention has been described with reference to a particular construction of apparatus it is to be understood that the described embodiment is given by way of illustration only and is not to be construed as limiting.

I claim:

1. A mobile seed cleaning apparatus which comprises a mobile chassis for mounting a plurality of cleaning or separating stations sequentially interconnected so as to cause seed to be cleaned to pass from a first station to a last station;

coarse screen means onto which the seed is fed having a predetermined screen size for separating material larger than said screen size by permitting the seed to pass through the screen;

air separator means having an air duct means and a blower means for removing relatively light material;

pocket cylinder means comprising two hollow cylinders having internal surfaces formed with a plurality of pockets to receive individual seeds, and being rotatable at predetermined speeds about their respective axes, the axes being inclined downwardly from an inlet end to an outlet end of said cylinder, and having means to vary the axis inclination of each cylinder;

a collector trough in each of said cylinders extending longitudinally therethrough, each collector trough having a seed auger therein;

means for moving the trough about a longitudinal axis to vary the position of an upper, open side of the trough relative to the cylinder, the outlet end of each cylinder opening into a first chamber and the outlet of each collector trough opening into a second chamber, each of the first and second chambers having waste outlet passages and seed outlet passages;

door means for directing material in each chamber to either of the passages;

screen cylinder means having interchangeable screen cylinders rotatable about a longitudinal axis and internal scraper means to urge the seed through the screen cylinders; and conveyor means continuously moving the seed from one station to the next.

2. The coarse screen apparatus as claimed in claim 1 wherein said coarse screen means comprises a cylindrical screen mesh rotatable about its axis at a predetermined speed and a baffle means for directing the seed onto the surface of the cylinder, the mesh size being such as to enable the seed to pass through the cylinder to a seed outlet therebelow while material larger than the mesh size is carried by the rotating cylinder to be deposited in a waste outlet.

3. Apparatus as claimed in claim 1 wherein a threshing machine is disposed above the coarse screen means and is selectively operable to thresh seed fed thereto.

4. Apparatus as claimed in claim 1 wherein said air separator means is mounted adjacent said coarse screen means and receives seed therefrom, said air separator means including a throat at a lower end of the air duct means through which air is drawn, the throat having an area less than the cross-sectional area of the air duct means to thereby constitute venturi means, wall means for directing seed from said coarse screen means towards said throat, and conveyor channel means beneath said throat.

5. Apparatus as claimed in claim 4 wherein said blower means discharges air and entrained material to a cyclone collector disposed on the rear of the mobile chassis.

6. Apparatus as claimed in claim 4 wherein said air duct means extends vertically and has an elongated crosssectional shape defined by the walls thereof, one wall having a transparent window therein.

7. Apparatus as claimed in claim 4 wherein a seed auger is rotatably mounted in said conveyor channel to convey seed to an elevator means which feeds the pocket cylinder means.

8. Apparatus as claimed in claim 1 wherein the seed outlet passage of the pocket cylinder means feeds the seed to an elevator which feeds the screen cylinder means.

9. Apparatus as claimed in claim 1 wherein said screen cylinder means comprises at least one hollow cylindrical member formed of a screen mesh of predetermined mesh size, means to rotate the cylinder at a predetermined speed and paddle means coaxial with the cylinder and mounted for rotation inside the cylinder, the paddle means having flexible or resilient scrapers engaged with the cylinder interior surface, the paddle means and cylinder being rotated at different speeds.

10. Apparatus as claimed in claim 9 wherein the screen cylinder means comprises two coaxial screen mesh cylindrical members connected end-to-end, each member having an internal paddle means.

11. Apparatus as claimed in claim 10 wherein a first of said cylindrical members has a mesh size less than the size of seed while the second cylindrical member has a mesh size greater than the seed size so that seed passes through the mesh to a conveyor.

12. Apparatus as claimed in claim 1 further including weighing means to continuously weigh seed which passes through the screen cylinders.

13. Apparatus as claimed in claim 1 further including pickling means operable in accordance with measured amounts of cleaned seed to deposit a predetermined amount of fungicide, pesticide, mold inhibitor or other chemical onto the measured amount of seed.

14. Apparatus according to claim 13, wherein a mixing and conveying auger mixes the pickled seed during conveyance to a bagging hopper, said auger comprising a seed auger of a predetermined diameter rotatable within a tube having an internal diameter of between 3% and 20% greater than the auger diameter.

* * * * *